US011214919B2

(12) United States Patent
Krause et al.

(10) Patent No.: US 11,214,919 B2
(45) Date of Patent: Jan. 4, 2022

(54) WET WEB STRENGTH FOR FIBERGLASS MATS

(71) Applicant: Ecolab USA Inc., St. Paul, MN (US)

(72) Inventors: Adam Krause, Champaign, IL (US); James Rieck, Chesterfield, MO (US); David Lucas, Metamora, IL (US); Eric J. Ouderkirk, Oswego, IL (US); Janet R. Kirkman, Naperville, IL (US); Robert M. Lowe, Chicago, IL (US); Alexandra Knoth, Aurora, IL (US)

(73) Assignee: Ecolab USA Inc., St. Paul, MN (US)

( * ) Notice: Subject to any disclaimer, the term of this patent is extended or adjusted under 35 U.S.C. 154(b) by 112 days.

(21) Appl. No.: 16/424,931

(22) Filed: May 29, 2019

(65) Prior Publication Data

US 2019/0368122 A1 Dec. 5, 2019

Related U.S. Application Data

(60) Provisional application No. 62/678,721, filed on May 31, 2018.

(51) Int. Cl.

| | |
|---|---|
| ***D06M 15/263*** | (2006.01) |
| ***D04H 1/4218*** | (2012.01) |
| ***D04H 1/64*** | (2012.01) |

(52) U.S. Cl.

CPC ..... *D06M 15/263* (2013.01); *D04H 1/4218* (2013.01); *D04H 1/64* (2013.01); *D10B 2101/06* (2013.01); *D10B 2401/063* (2013.01)

(58) Field of Classification Search

CPC ..... D06M 15/263; D04H 1/4218; D04H 1/64

See application file for complete search history.

(56) References Cited

U.S. PATENT DOCUMENTS

| | | | |
|---|---|---|---|
| 3,450,555 | A | 6/1969 | Bridgeford |
| 3,976,824 | A | 8/1976 | Ariyoshi et al. |
| 3,988,503 | A | 10/1976 | Arihoshi et al. |
| 4,178,204 | A | 12/1979 | Chakrabarti |
| 4,245,689 | A | 1/1981 | Grard et al. |
| 4,536,446 | A | 8/1985 | Hsu et al. |

(Continued)

FOREIGN PATENT DOCUMENTS

| | | | |
|---|---|---|---|
| CN | 105369616 | A | 3/2016 |
| EP | 045638 | A1 | 10/1991 |

(Continued)

*Primary Examiner* — Nathan T Leong

(74) *Attorney, Agent, or Firm* — Leydig, Voit & Mayer, Ltd.

(57) ABSTRACT

Methods of and systems for treating a web of chopped nonwoven mineral fibers passing through a chopped nonwoven mineral fiber mat process are provided. The methods comprise spraying strength aid onto the web of chopped nonwoven mineral fibers in a forming section of the chopped nonwoven mineral fiber mat process. The systems comprise a first spray bar comprising a delivery conduit configured to provide a flow of strength aid at a flow rate to one or more nozzles in fluid communication with the delivery conduit. The one or more nozzles are configured to receive the strength aid from the delivery conduit and to spray of the strength aid onto the web of chopped nonwoven mineral fibers in the forming section of the chopped nonwoven mineral fiber mat process.

15 Claims, 4 Drawing Sheets

(56) References Cited

U.S. PATENT DOCUMENTS

| | | | | |
|---|---|---|---|---|
| 4,810,576 | A * | 3/1989 | Gaa | C03C 25/26 428/375 |
| 5,800,899 | A | 9/1998 | Sandvig et al. | |
| 5,804,254 | A | 9/1998 | Nedwick et al. | |
| 6,346,319 | B1 | 2/2002 | Cochran | |
| 6,365,000 | B1 | 4/2002 | Dwiggins et al. | |
| 6,896,768 | B2 | 5/2005 | Dwiggins et al. | |
| 7,303,650 | B2 | 12/2007 | Hermans et al. | |
| 7,683,121 | B2 | 3/2010 | Wei et al. | |
| 9,546,263 | B2 | 1/2017 | Hawkins et al. | |
| 9,657,478 | B2 | 5/2017 | Belt et al. | |
| 2004/0219847 | A1* | 11/2004 | Miller | D04H 1/587 442/104 |
| 2004/0254285 | A1 | 12/2004 | Rodrigues et al. | |
| 2008/0299852 | A1 | 12/2008 | Lee et al. | |
| 2013/0299109 | A1 | 11/2013 | Hietaniemi et al. | |
| 2016/0320303 | A1* | 11/2016 | Hjelmgaard | G01N 21/6408 |

FOREIGN PATENT DOCUMENTS

| | | | |
|---|---|---|---|
| EP | 2093266 | A1 | 8/2009 |
| EP | 3056549 | A1 | 8/2016 |
| WO | WO 2017/086851 | A1 | 5/2017 |

* cited by examiner

WET WEB STRENGTH FOR FIBERGLASS MATS

CROSS-REFERENCE TO RELATED APPLICATIONS

This application claims the benefit of U.S. Provisional Application No. 62/678,721, filed May 31, 2018, the disclosure of which is incorporated by reference herein in its entirety.

BACKGROUND OF THE INVENTION

Chopped mineral fibers (e.g., glass fibers) have been utilized in the production of various materials, including, among others, roofing shingles and gypsum board facing. Generally, chopped mineral fibers are manufactured from molten glass as is known in the art via a fiberizing apparatus.

Materials such as roofing shingles and gypsum board facing can be made (at least partially) from chopped mineral fibers formed into nonwoven mineral fiber substrate (i.e., mat). Generally, to produce nonwoven mineral fiber mat, wet chopped fibers are dispersed in a water slurry that contains water and chemical agents. The chopped fibers are agitated such that they become dispersed in the slurry, which is then deposited onto a moving screen, forming a web of nonwoven mineral fibers (i.e., a chopped nonwoven mineral fiber mat). Vacuum is pulled on the nonwoven mineral fiber mat through the screen, thereby removing at least a portion of the water and chemical agents from the chopped nonwoven mineral fiber mat. Binder is applied to the mat and cured, forming a mat that can be further processed into, e.g., roofing shingles or gypsum board facing.

Generally, the aforementioned process is performed in a continuous, automated fashion as fast as possible. Thus, nonwoven mineral fiber mat producers generally prefer to operate the mat-producing process as fast as possible, assuming that quality standards are met.

BRIEF SUMMARY OF THE INVENTION

A method of treating a web of chopped nonwoven mineral fibers passing through a chopped nonwoven mineral fiber mat process is provided. The method comprises spraying strength aid onto the web of chopped nonwoven mineral fibers in a forming section of the chopped nonwoven mineral fiber mat process at a concentration of from about 0.1% to about 20% by weight active ingredient and at a flow rate of from about 0.1 g to about 35 g active ingredient per 100 square feet of surface area of the web of chopped nonwoven mineral fibers.

A system for delivering strength aid to a web of chopped nonwoven mineral fibers passing through a forming section of a chopped nonwoven mineral fiber mat process at a web speed is provided. The system comprises a first spray bar comprising a delivery conduit configured to provide a flow of strength aid at a flow rate to one or more nozzles in fluid communication with the delivery conduit, the one or more nozzles configured to receive the strength aid from the delivery conduit and to spray of the strength aid to the web of chopped nonwoven mineral fibers in the forming section of the chopped nonwoven mineral fiber mat process; and a flow control apparatus in fluid communication with a source of strength aid and the delivery conduit for metering the flow of the strength aid to the one or more nozzles, configured to meter the strength aid flow rate at from about 0.1 g to about 35 g active ingredient per 100 square feet of surface area of the web of chopped nonwoven mineral fibers.

DETAILED DESCRIPTION OF THE INVENTION

A method of treating a web of chopped nonwoven mineral fibers passing through a chopped nonwoven mineral fiber mat process is provided. The method comprises spraying strength aid onto the web of chopped nonwoven mineral fibers in a forming section of the chopped nonwoven mineral fiber mat process at a concentration of from about 0.1% to about 20% by weight active ingredient and at a flow rate of from about 0.1 g to about 35 g active ingredient per 100 square feet of surface area of the web of chopped nonwoven mineral fibers.

A system for delivering strength aid to a web of chopped nonwoven mineral fibers passing through a forming section of a chopped nonwoven mineral fiber mat process at a web speed is provided. The system comprises a first spray bar comprising a delivery conduit configured to provide a flow of strength aid at a flow rate to one or more nozzles in fluid communication with the delivery conduit, the one or more nozzles configured to receive the strength aid from the delivery conduit and to spray of the strength aid to the web of chopped nonwoven mineral fibers in the forming section of the chopped nonwoven mineral fiber mat process; and a flow control apparatus in fluid communication with a source of strength aid and the delivery conduit for metering the flow of the strength aid to the one or more nozzles, configured to meter the strength aid flow rate at from about 0.1 g to about 35 g active ingredient per 100 square feet of surface area of the web of chopped nonwoven mineral fibers.

A method of treating a web of chopped nonwoven mineral fibers passing through a nonwoven mineral fiber mat process is provided. Treatment of a web of chopped nonwoven mineral fibers passing through a chopped nonwoven mineral fiber mat process may occur in one or more of several ways and for one or more of several reasons. When the strands of mineral fibers are coated with strength aid, the resulting mat has been shown to be stronger than when not coated with strength aid.

Figure 1:
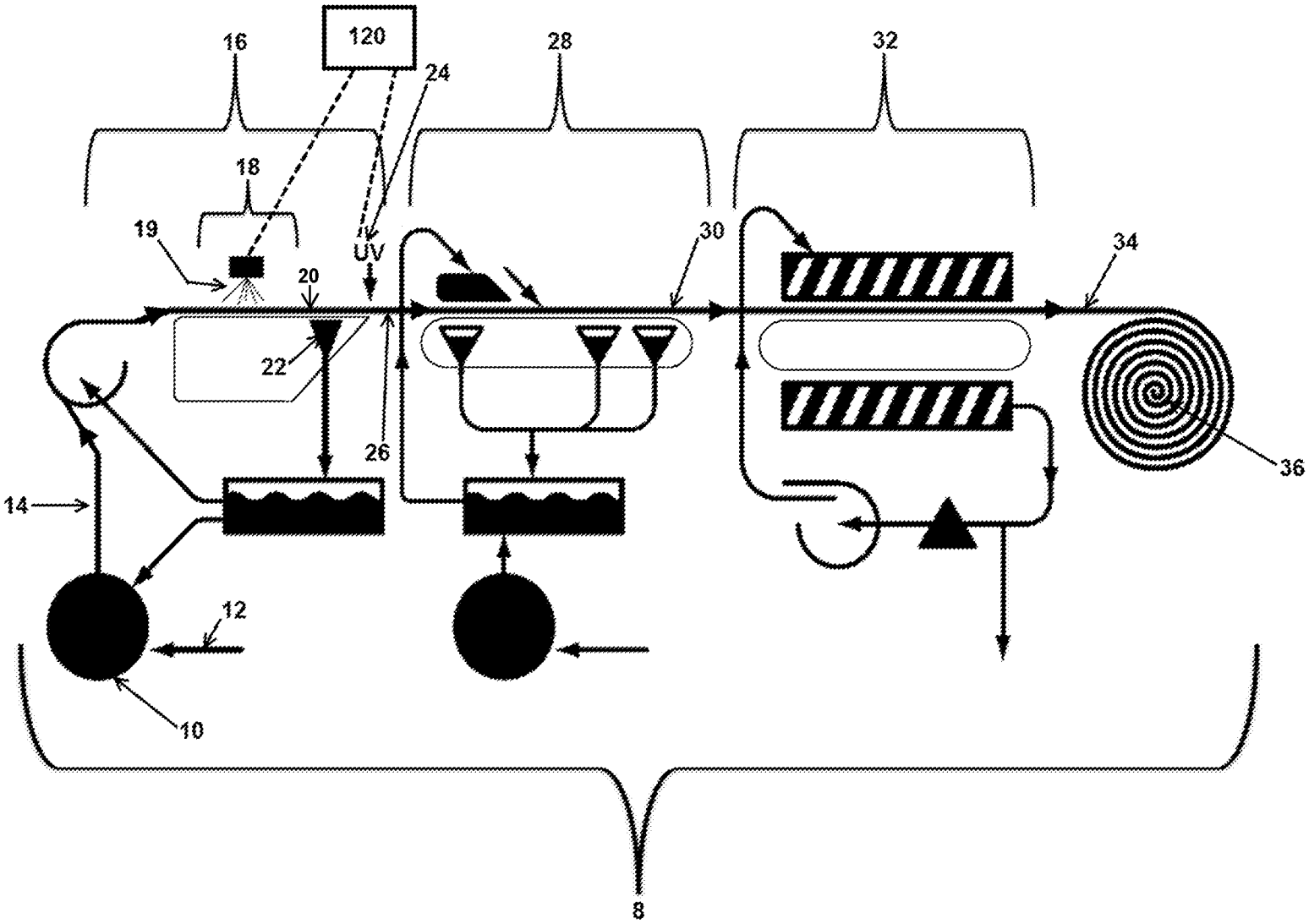
FIG. 1 shows a schematic view of a chopped nonwoven mineral fiber mat process.

An example of a chopped nonwoven mineral fiber mat process 8 is shown in FIG. 1. As shown in FIG. 1, chopped mineral (e.g., glass) fibers are placed in a chamber 10 via mineral inlet 12, along with water and chemical agents (not shown) to form a slurry. The slurry is agitated and delivered onto a screen to form a web of chopped nonwoven mineral fibers 14 in a forming section 16 of the process. As the web of chopped nonwoven mineral fibers travels through the process, the web of chopped nonwoven mineral fibers 14 passes through a treatment zone 18 for delivering strength aid 19 that, for the methods and systems provided herein, includes spraying strength aid 19 onto the web of chopped nonwoven mineral fibers 14, to form strength aid-enhanced mat 20. As shown, the treatment zone 18 is located upstream of vacuum 22, which draws water and chemical agent, likely including a portion of the strength aid 19, from the web 14 in the forming section 16. An optional optical light source and/or monitor 24 may be located downstream of the treatment zone 18. As shown, an optional optical detection light source and/or monitor 24 is located downstream of vacuum 22, though other locations downstream of treatment zone 18 are envisioned. The post-vacuum strength aid-enhanced mat 26 is then treated with binder (e.g., resin) at a binder application stage 28 to form binder-treated mat 30. The binder-treated mat 30 is then cured at a curing stage 32 to form cured mat 34. As shown in FIG. 1, the cured mat 34 may be optionally rolled 36 for storage prior to, e.g., further processing.

For the methods and systems provided herein, strength aid is sprayed onto the web of chopped nonwoven mineral fibers in a forming section of the nonwoven mineral fiber mat process. Generally, delivery of strength aid may be accomplished in any one or more of several fashions. However, as described herein, spraying at a concentration of about 0.1% to about 20% by weight and at a rate of from about 0.1 g to about 35 g per 100 square feet of surface area of the web of chopped nonwoven mineral fibers has been shown to impart strength to a web of chopped nonwoven mineral fibers at a relatively low dosage of strength aid.

As described herein, mineral fibers can be utilized in several different types of materials, including building materials and other materials. The term "mineral fibers" is not particularly limited. An example of a mineral fiber is a glass fiber. In embodiments described herein, the mineral fibers are chopped and formed in a nonwoven web. The term "chopped" is utilized to indicate that the individual strands of mineral fibers are not infinite in length, but are of discrete length. "Nonwoven" is utilized to indicate that the individual strands of mineral fibers are generally randomly oriented in the web and are not woven between each other. A person having ordinary skill in the art would recognize what is meant by the phrase "chopped nonwoven mineral fibers" and similar phrasing. In certain embodiments of the methods and systems provided herein, the chopped nonwoven mineral fibers comprise chopped nonwoven glass fibers. In certain embodiments of the methods and systems provided herein, the chopped nonwoven mineral fibers are chopped nonwoven glass fibers. In certain embodiments of the methods and systems provided herein, the web of chopped nonwoven mineral fibers has a thickness of from about 10 to about 45 mil (i.e., 0.001 inch equals 1 mil).

Strength aid is delivered to the web of chopped nonwoven mineral fibers. The selection of strength aid is not particularly limited, and the processes and systems provided herein have been demonstrated to provide benefit across strength aids generally. While not being particularly limited, the selected strength aid, when delivered to the web of chopped nonwoven mineral fibers as provided herein, generally imparts strength to the web of chopped nonwoven mineral fibers, thereby allowing the chopped nonwoven mineral fiber mat process to operate at a speed greater than if the strength aid is not delivered to the web of chopped nonwoven mineral fibers as provided herein.

The strength aid is generally liquid substance (e.g., a dispersion, emulsion, solution, slurry, or the like) comprising active ingredient, e.g., a polymeric strength aid that imparts added strength to the web as described herein, having a relatively low concentration in a solvent (e.g., water). In certain embodiments of the methods provided herein, the strength aid is cationic, anionic, nonionic, or amphoteric. In certain embodiments of the methods provided herein, the strength aid is anionic or cationic. In certain embodiments of the methods provided herein, the strength aid is anionic. In certain embodiments of the methods provided herein, the strength aid is cationic.

In certain embodiments of the methods provided herein, the strength aid has a concentration of from about 0.1% to about 20% by weight active ingredient. In certain embodiments of the methods provided herein, the strength aid has a concentration of from about 0.3% to about 12% by weight active ingredient. In certain embodiments of the methods provided herein, the strength aid is a polymeric anionic strength aid having a concentration of from about 0.1% to about 20% by weight active ingredients. In certain embodiments of the methods provided herein, the strength aid is a polymeric anionic strength aid having a concentration of from about 0.3% to about 12% by weight active ingredients. In certain embodiments of the methods provided herein, the strength aid is a polymeric cationic strength aid having a concentration of from about 0.1% to about 20% by weight active ingredients. In certain embodiments of the methods provided herein, the strength aid is a polymeric cationic strength aid having a concentration of from about 0.3% to about 12% by weight active ingredients.

As used herein, the term "concentration" is utilized to describe the amount of active ingredient present in the strength aid. The term "dose" or "dosage" is utilized to describe the amount or rate of active ingredient being delivered to the web of chopped nonwoven mineral fibers. Accordingly, "dose/dosage" and "concentration" are variables independent of one another, and a relatively large dose of strength aid could be delivered to a web of chopped nonwoven mineral fibers at a relatively low concentration. Conversely, a relatively small dose of strength aid could be delivered to a web of chopped nonwoven mineral fibers at a relatively high concentration.

In certain embodiments of the methods provided herein, the strength aid is sprayed onto the web of chopped nonwoven mineral fibers at a flow rate of from about 0.1 g to about 35 g active ingredient per 100 square feet of surface area of the web of chopped nonwoven mineral fibers. The term "surface area" is utilized herein to describe the approximate area of the web that would be sprayed if the web were a solid surface instead of a series of mineral fiber strands. The surface area rate is determined utilizing the width of the web being sprayed, the speed of the chopped nonwoven mineral fiber mat process (i.e., "mat speed"), and the flow rate of the strength aid. In certain embodiments of the methods provided herein, the strength aid is sprayed onto the web of chopped nonwoven mineral fibers at a flow rate of from about 1 g to about 35 g active ingredient per 100 square feet of surface area of the web of chopped nonwoven mineral fibers. In certain embodiments of the methods provided herein, the strength aid is sprayed onto the web of chopped nonwoven mineral fibers at a flow rate of from about 5 g to about 35 g active ingredient per 100 square feet of surface area of the web of chopped nonwoven mineral fibers. In certain embodiments of the methods provided herein, the strength aid is sprayed onto the web of chopped nonwoven mineral fibers at a flow rate of from about 5 g to about 15 g active ingredient per 100 square feet of surface area of the web of chopped nonwoven mineral fibers.

In certain embodiments of the methods provided herein, the active ingredient of the strength aid comprises one or more anionic polymers, e.g., one or more copolymer of acrylic acid (i.e., acrylate) and acrylamide, one or more copolymer of ethylene and acrylate ("EAA"), ethylene oxide and acrylate, carboxymethylcellulose, a dialdehyde-modified polyacrylamide, and similar compounds, including salts thereof. In certain embodiments of the methods provided herein, the active ingredient of the strength aid comprises one or more cationic polymers, e.g., polyaminoamide-epichlorohydrin ("PAE") polymers.

In certain embodiments of the methods provided herein, the active ingredient of the strength aid comprises an acrylate-containing polymer. In certain embodiments of the methods provided herein, the active ingredient of the strength aid comprises an acrylate-acrylamide copolymer. In certain embodiments of the methods provided herein, the active ingredient of the strength aid is an acrylate-acrylamide copolymer. In certain embodiments of the methods provided herein, the active ingredient of the strength aid comprises a polyaminoamide-epichlorohydrin ("PAE") copolymer. In certain embodiments of the methods provided herein, the active ingredient of the strength aid is a polyaminoamide-epichlorohydrin ("PAE") copolymer.

In certain embodiments of the methods and systems provided herein, the strength aid further comprises an optical detection compound. When present in the strength aid, an optical detection compound can allow for the ability to monitor spray coverage of the strength aid delivered to the web of chopped nonwoven mineral fibers. In certain embodiments of the methods and systems provided herein, the optical detection compound comprises a component that can be detected in the web via ultraviolet light. In certain embodiments of the methods and systems provided herein, the optical detection compound comprises an inert tracer. Examples of inert tracers (or classes thereof) include, but are not limited to, fluorescein, rhodamine, naphthalene sodium sulfonate-formaldehyde condensate, and di/tetra/hexa-sulfonated stilbenes.

Utilization of relatively higher concentration and lower dosage spray to deliver strength aid to a web of chopped nonwoven mineral fiber is contrary to the prevailing notion in the art that relatively high volume but relatively low concentration spray would provide improved delivery of active ingredient throughout the web. In other words, utilization of the methods and systems provided herein have produced unpredictable benefit and unexpected results.

Figure 2:
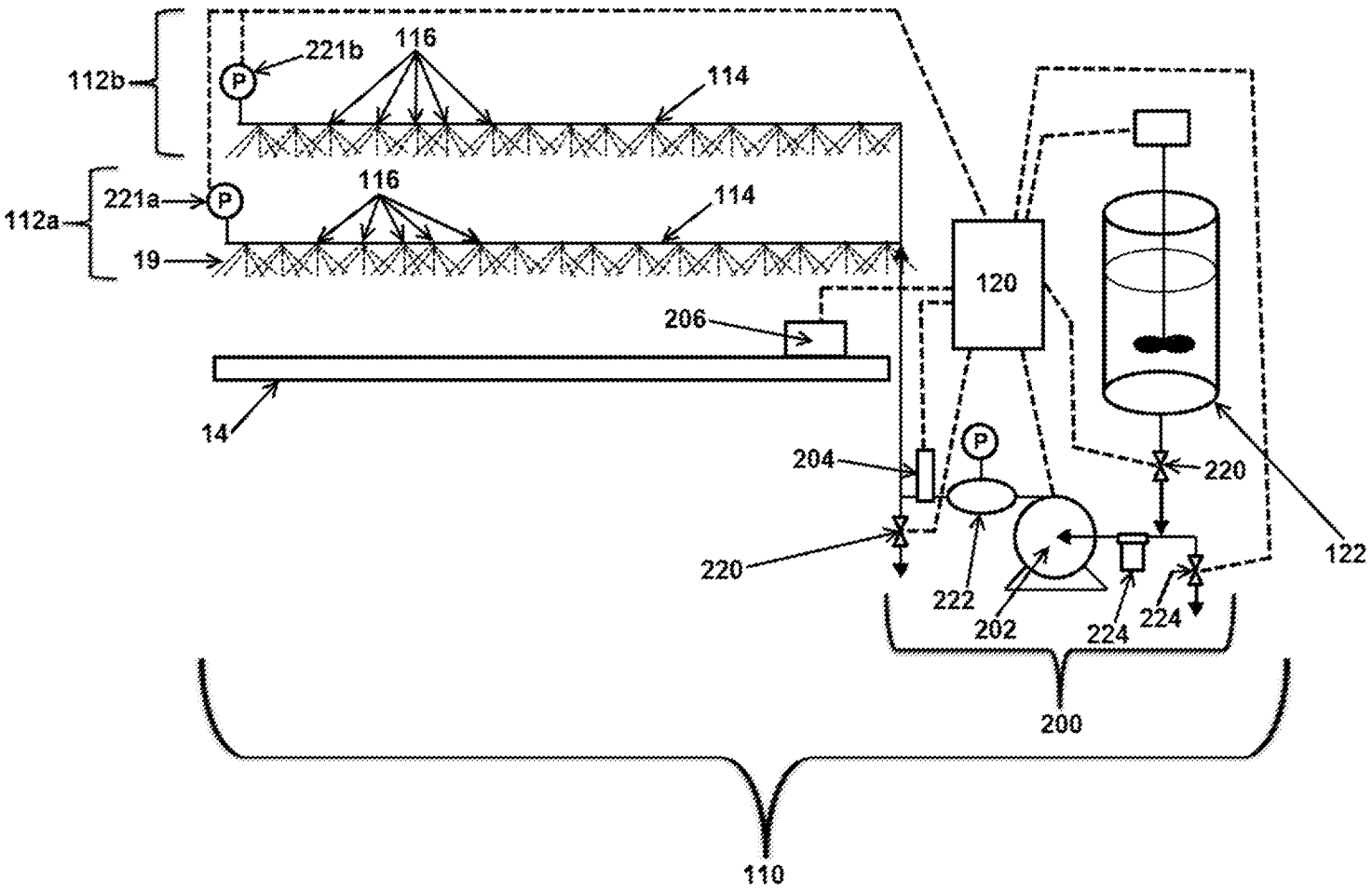
FIG. 2 shows a perspective view of a portion of a forming section of a chopped nonwoven mineral fiber mat process and an embodiment of a system for delivering strength aid to a web of chopped nonwoven mineral fibers passing through the forming section of the chopped nonwoven mineral fiber mat process.

A system for delivering strength aid to a web of chopped nonwoven mineral fibers passing through a forming section of a chopped nonwoven mineral fiber mat process at a web speed is provided, an example of which is described herein at least in part in connection with FIGS. 1 and 2. More specifically, the system comprises a delivery conduit configured to provide a flow of strength aid at a flow rate to one or more spray nozzles in fluid communication with the delivery conduit, the one or more spray nozzles configured to receive the strength aid from the delivery conduit and to deliver a spray of the strength aid to the web of chopped nonwoven mineral fibers in the forming section of the chopped nonwoven mineral fiber mat process. The system further comprises a flow control apparatus in fluid communication with a source of strength aid and the delivery conduit for metering the flow of the strength aid to the one or more spray nozzles at a flow rate of from about 0.1 g to about 35 g active ingredient per 100 square feet of surface area of the web of chopped nonwoven mineral fibers.

The web of chopped nonwoven mineral fibers pass through a forming section of a chopped nonwoven mineral fiber mat process at a web speed. Generally, as described herein, a nonwoven mineral fiber mat manufacturer would desire the process to operate at a maximum speed while maintaining all identified quality standards that need to be met. Delivery of strength aid to the web generally imparts strength to the web, thereby allowing the manufacturer to operate the process at a greater web speed.

FIG. 1 is a schematic illustration of an exemplary embodiment of a chopped nonwoven mineral fiber mat process 8 equipped with a system for delivering strength aid to a web of chopped nonwoven mineral fibers 14 passing through a treatment zone 18 of a forming section 16 of the chopped nonwoven mineral fiber mat process 8 as described herein. FIG. 2 is a schematic illustration of an exemplary embodiment of a system 110 for delivering strength aid 19 to a web of chopped nonwoven mineral fibers 14 passing through a forming section 16 (FIG. 1) of a chopped nonwoven mineral fiber mat process 8 (FIG. 1).

As shown in FIG. 2, the system 110 comprises a first spray bar 112*a*. The first spray bar 112*a* comprises a delivery conduit 114 configured to provide a flow of strength aid 19 at a flow rate to one or more nozzles 116 (25 in total shown in FIG. 2). The one or more nozzles 116 are in fluid communication with delivery conduit 114, so as to receive the strength aid 19 from delivery conduit 114 and to spray the strength aid 19 to the web of chopped nonwoven mineral fibers 14 in the forming section 16 (FIG. 1) of the chopped nonwoven mineral fiber mat process 8 (FIG. 1). Certain embodiments of the system further comprise an optical detection light source and/or monitor 24 (FIG. 1), which may be in communication with flow control apparatus 120.

In certain embodiments of the system, a second spray bar 112*b*. The second spray bar 112*b* may be constructed substantially the same as first spray bar 112*a*, or may vary in construction, so long as second spray bar 112*b* is capable of spraying strength aid onto the web of chopped nonwoven mineral fibers. In certain embodiments, the system is configured to activate second spray bar 112*b* upon an upset in the flow rate of the strength aid passing through first spray bar 112*a*.

Generally, the wetted portions of the system should be constructed of materials suitable for contact with the strength aid. Examples of materials generally suitable for contact with the strength aid include, but are not limited to, stainless steel, polyvinyl chloride, chlorinated polyvinyl chloride, polyethylene, and/or polypropylene.

The delivery conduit may be constructed of any suitable manifold-like hardware that is typically utilized for delivering a contained flow of liquid. For example, the delivery conduit may be constructed of pipe or tubing having an inlet and one or more outlets so as to be in fluid communication with the flow control apparatus and the one or more nozzles.

The one or more spray nozzles are not particularly limited, so long as the spray nozzles are capable of providing spray at a flow rate of from about 0.1 g to about 35 g active ingredient per 100 square feet of surface area of the web of chopped nonwoven mineral fibers. The spray nozzles may be any suitable nozzles capable of providing a spray as described herein of strength aid to the web of chopped nonwoven mineral fibers. In certain embodiments of the methods and systems provided herein, the spray is provided by a single nozzle. In certain embodiments of the methods and systems provided herein, the spray is provided by a plurality of nozzles. For embodiments comprising a plurality of nozzles, each nozzle may be the same or different type of nozzle (e.g., may be a different size, shape, configuration, etc.), and for embodiments comprising more than two nozzles, each nozzle may be the same or different type of nozzle or combinations thereof. While the utilization of other spray patterns is envisioned, in certain embodiments of the methods provided herein, the spray is flat spray (e.g., fan spray), full cone spray, or a combination thereof. In certain embodiments of the methods provided herein, the spray is flat spray (e.g., fan spray). While the utilization of other nozzles is envisioned, in certain embodiments of the systems provided herein, the nozzles are flat nozzles (e.g., fan nozzles), full cone nozzles, or a combination thereof. In certain embodiments of the systems provided herein, the nozzles are flat nozzles (e.g., fan nozzles).

The system further comprises a flow control apparatus 120 in fluid communication with a source 122 of strength aid 19 and delivery conduit 114 for metering the flow of the strength aid 19 to the one or more nozzles 116. The flow control apparatus may be as simple as a delivery device (e.g., a pump) with an on-off switch that can be manually operated, or as complicated as a control system 200 (FIG. 2) that includes, for example, a flow meter 204, a web speed detection device 206 or relay, and a delivery device 202 (e.g., pump) having variable flow control and controlled according to variables (e.g., strength aid flow rate and web speed) provided to flow control apparatus 120 (i.e., "controller"). As shown in FIG. 2, valves 220, a dampener 222, and/or a strainer 224 may be present in the control system 200.

As it pertains to this disclosure, unless otherwise indicated, "controller" refers to an electronic device having components such as a processor, memory device, digital storage medium, cathode ray tube, liquid crystal display, plasma display, touch screen, or other monitor, and/or other components. Controllers include, for example, an interactive interface that guides a user, provides prompts to the user, or provides information to the user regarding any portion of the method of the invention. Such information may include, for example, building of calibration models, data collection of one or more parameters, measurement location(s), management of resulting data sets, etc.

When present, the controller 120 may be operable for integration and/or communication with one or more application-specific integrated circuits, programs, computer-executable instructions or algorithms, one or more hard-wired devices, wireless devices, and/or one or more mechanical devices such as liquid handlers, hydraulic arms, servos, or other devices. Moreover, the controller is operable to integrate feedback, feed-forward, or predictive loop(s) resulting from, inter alia, the parameters measured by practicing the method(s) of the present disclosure. Some or all of the controller system functions may be at a central location, such as a network server, for communication over a local area network, wide area network, wireless network, extranet, the Internet, microwave link, infrared link, and the like, and any combinations of such links or other suitable links. In addition, other components such as a signal conditioner or system monitor may be included to facilitate signal transmission and signal-processing algorithms.

By way of example, in certain embodiments of the methods and systems provided herein, the controller is operable to implement the method of the invention in a semi-automated or fully-automated fashion. In another embodiment, the controller is operable to implement the method in a manual or semi-manual fashion.

Data transmission of any of the measured parameters or signals to a user, chemical pumps, alarms, or other system components is accomplished using any suitable device, such as, e.g., a wired or wireless network, cable, digital subscriber line, internet, etc. Any suitable interface standard(s), such as an ethernet interface, wireless interface (e.g., IEEE 802.11a/b/g/n, 802.16, Bluetooth, optical, infrared, other radiofrequency, any other suitable wireless data transmission method, and any combinations of the foregoing), universal serial bus, telephone network, the like, and combinations of such interfaces/connections may be used. As used herein, the term "network" encompasses all of these data transmission methods. Any of the components, devices, sensors, etc., herein described may be connected to one another and/or the controller using the above-described or other suitable interface or connection. In an embodiment, information (collectively referring to all of the inputs or outputs generated by the method(s) of the invention) is received from the system and archived. In another embodiment, such information is processed according to a timetable or schedule. In a further embodiment, such information is processed in real-time. Such real-time reception may also include, for example, "streaming data" over a computer network.

As it pertains to this disclosure, unless otherwise indicated, "control scheme" refers to providing output based on input from a controller as defined herein. In certain embodiments of the system provided herein, the flow control apparatus comprises a control system. In certain embodiments of the system provided herein, the flow control apparatus comprises a control system configured to automatically adjust the flow rate of the strength aid being delivered to the web based upon the web speed.

1. A method of treating a web of chopped nonwoven mineral fibers passing through a chopped nonwoven mineral fiber mat process comprising:

spraying strength aid onto the web of chopped nonwoven mineral fibers in a forming section of the chopped nonwoven mineral fiber mat process at a concentration of from about 0.1% to about 20% by weight active ingredient and at a flow rate of from about 0.1 g to about 35 g active ingredient per 100 square feet of surface area of the web of chopped nonwoven mineral fibers.

2. The method of claim 1, wherein the strength aid is cationic, anionic, nonionic, or amphoteric.

3. The method of claim 1, wherein the strength aid is anionic or cationic.

4. The method of claim 1, wherein the strength aid is anionic.

5. The method of claim 1, wherein the strength aid is cationic.

6. The method of any one of claims 1-5, wherein the strength aid is sprayed onto the web of chopped nonwoven mineral fibers at a concentration of from about 0.3% to about 12% by weight active ingredient.

7. The method of any one of claims 1-6, wherein the active ingredient of the strength aid comprises an acrylate-containing polymer.

8. The method of any one of claims 1-6, wherein the active ingredient of the strength aid comprises an acrylate-acrylamide copolymer.

9. The method of any one of claims 1-6, wherein the active ingredient of the strength aid is an acrylate-acrylamide copolymer.

10. The method of any one of claims 1-9, wherein the strength aid is sprayed onto the web at a forming section of the chopped nonwoven mineral fiber mat process.

11. The method of any one of claims 1-9, wherein the strength aid is sprayed onto the web downstream of a forming head of the chopped nonwoven mineral fiber mat process.

12. The method of any one of claims 1-9, wherein the strength aid is sprayed onto the web upstream of a vacuum section of the chopped nonwoven mineral fiber mat process.

13. The method of any one of claims 1-9, wherein the strength aid is sprayed onto the web downstream of a forming head and upstream of a vacuum section of the chopped nonwoven mineral fiber mat process.

14. The method of any one of claims 1-13, wherein the chopped nonwoven mineral fibers comprise glass fibers.

15. The method of claim 14, wherein the chopped nonwoven mineral fibers are glass fibers.

16. The method of any one of claims 1-13, wherein the web of chopped nonwoven mineral fibers has a thickness of from about 10 to about 45 mil.

17. The method of any one of claims 1-16, wherein the strength aid further comprises an optical detection compound.

18. The method of claim 17, wherein the optical detection compound comprises fluorescein, rhodamine, naphthalene sodium sulfonate-formaldehyde condensate, di-sulfonated stilbene, tetra-sulfonated stilbene, hexa-sulfonated stilbene, a derivative thereof, or a combination thereof.

19. The method of claim 17, wherein the optical detection compound, when sprayed onto the web, can be detected in the web via ultraviolet light.

20. The method of any one of claims 1-19, wherein the strength aid is sprayed onto the web of chopped nonwoven mineral fibers via flat spray.

21. A system for delivering strength aid to a web of chopped nonwoven mineral fibers passing through a forming section of a chopped nonwoven mineral fiber mat process at a web speed, the system comprising:

a first spray bar comprising a delivery conduit configured to provide a flow of strength aid at a flow rate to one or more nozzles in fluid communication with the delivery conduit, the one or more nozzles configured to receive the strength aid from the delivery conduit and to spray the strength aid to the web of chopped nonwoven mineral fibers in the forming section of the chopped nonwoven mineral fiber mat process; and a flow control apparatus in fluid communication with a source of the strength aid and the delivery conduit for metering the flow of the strength aid to the one or more nozzles, configured to meter the strength aid flow rate at from about 0.1 g to about 35 g actives per 100 square feet of surface area of the web of chopped nonwoven mineral fibers.

22. The system of claim 21, wherein the flow control apparatus is configured to detect the web speed.

23. The system of claim 21 or 22, wherein the flow control apparatus comprises a control system configured to automatically adjust the flow rate of the strength aid being sprayed onto the web based upon the web speed.

24. The system of any one of claims 21-23, further comprising a second spray bar.

25. The system of claim 24, wherein the system is configured to activate the second spray bar upon an upset in the flow rate of the strength aid passing through the first spray bar.

26. The system of any one of claims 21-25, wherein the one or more nozzles comprise flat nozzles.

27. The system of any one of claims 21-26, further comprising an optical detection light source.

28. The system of any one of claims 21-27, further comprising an optical detection light monitor.

EXAMPLES

The following examples further illustrate the invention but should not be construed as in any way limiting its scope.

Example 1

This example demonstrates the unexpected results that were achieved when delivering strength aid to a web of chopped nonwoven mineral fibers passing through a chopped nonwoven mineral fiber mat process according to the methods and systems provided herein. Strength aid was delivered via Test A) a conventional process at various dilutions utilizing a relatively high volume spray (control), and Test B) according to the methods and systems provided herein, utilizing a relatively lower flow rate at various dilutions generally more concentrated than those of Test A.

Figure 3:
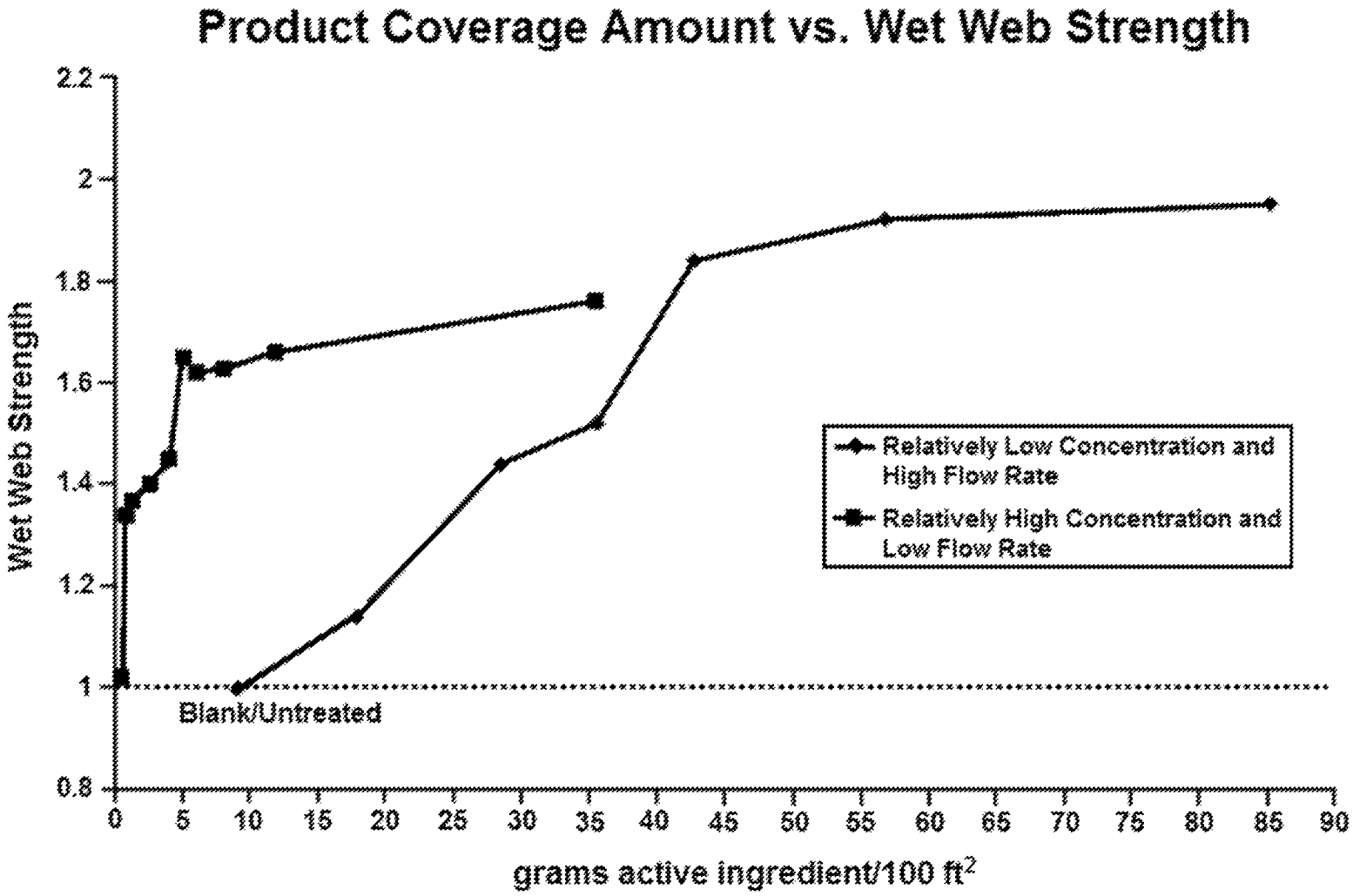
FIG. 3 illustrates wet web strength versus delivery of active ingredient of anionic strength aid, shown as grams of active ingredient per 100 square feet of web surface area.

One would have expected that an equal dosage of active ingredient applied to the web via relatively high volume spray and relatively lower flow rate would have resulted in approximately the same strength. However, as can be seen from FIG. 3, the methods and systems utilizing the methods and systems provided herein (e.g., at relatively higher concentration of active ingredient) resulted in improved strength of the web at comparably lower dosages than similar dosages of relatively lower concentration of active ingredient a comparable dosages (see, e.g., left side of the graph of FIG. 3). Thus, the methods and systems provided herein resulted in an unexpected increase in strength when the strength aid was delivered to the web of chopped nonwoven mineral fibers at a concentration of from about 0.1% to about 20% by weight active ingredient and at a flow rate of from about 0.1 g to about 35 g active ingredient per 100 square feet of surface area of the web of chopped nonwoven mineral fibers.

Example 2

For this example, hand sheets of chopped nonwoven mineral fibers were made using a standard procedure. A square of 1 ft. by 1 ft. piece of forming wire was placed over a drain, and a square steel barrier around the wire allows the whitewater to sit above the wire when the drain was closed. Ten gallons of whitewater was used for each hand sheet. Opening the drain allowed the whitewater to flow through the wire, leaving behind a square hand sheet web of chopped nonwoven mineral fibers. Moisture was vacuumed from each hand sheet twice by passing the wire over a vacuum.

To test strength, each hand sheet was placed over a circular hole under the center of each sheet with a block located therein. A cup of water was suspended over the circular hole. A flat plastic square with an identical hole was placed on top of the hand sheet to hold the hand sheet in place. Water was slowly added to the cup until the mat sagged low enough to touch the block located in the hole. The weight of the water (in oz.) was recorded.

A control sample of 63 hand sheets of chopped nonwoven mineral fibers from two separate manufacturers were tested to determine a baseline for which strength enhancement could be tested. Water was poured onto each of the hand sheets until the water caused the hand sheet to sag to a specified distance, and the fluid ounces of water at sagging was recorded for each hand sheet. The overall mean wet strength was 5.8 oz., with one of the manufacturer's mean strength being 5.47 oz., and the other manufacturer's mean strength being 5.95 oz. The overall standard deviation was 1.38. The raw data is shown in Table 1 below.

Samples of each manufacturer's hand sheets were treated with one each of three different strength aids: an acrylic acid-acrylamide copolymer, a zinc ionomer of EAA, and a magnesium ionomer of EAA. For these samples, each strength aid was made down to a 10% weight by active ingredient in soft water. Each solution was sprayed onto each hand sheet using a common spray bottle and in a uniform pattern. Only a single solution was applied per hand sheet. Moisture was vacuumed twice as described above, and strength was tested as described above.

The mean strength of all treated samples was 11.73 oz., with a standard deviation of 1.67. The treated average was more than 4 standard deviations higher than the untreated average. The results of this example demonstrate that the methods and systems provided herein may be utilized across strength aids to impart strength to chopped nonwoven mineral fibers. Table 2 includes results for the treated hand sheets.

TABLE 1

| Mat Type | Wet Strength (oz) |
|---|---|
| OC | 3.8 |
| OC | 5 |
| OC | 5 |
| OC | 5.8 |
| OC | 7 |
| IKO | 5.2 |
| IKO | 5.2 |
| IKO | 5.6 |
| IKO | 5.7 |
| IKO | 5.7 |
| OC | 6.2 |
| OC | 8 |
| OC | 5.2 |
| OC | 7.1 |
| OC | 7.2 |
| IKO | 7.5 |
| IKO | 5.4 |
| IKO | 5.7 |
| IKO | 6 |
| IKO | 5.9 |
| IKO | 4.23 |
| IKO | 3.53 |
| IKO | 5.39 |
| OC | 7.23 |
| OC | 7.05 |
| OC | 6.34 |
| IKO | 5.4 |
| IKO | 5 |
| IKO | 3.7 |
| IKO | 6.2 |
| IKO | 4.5 |
| IKO | 5 |
| IKO | 3.8 |
| IKO | 7.7 |
| IKO | 6.2 |
| IKO | 4.7 |
| IKO | 8 |
| OC | 5.1 |
| OC | 3.5 |
| OC | 6.1 |
| OC | 3.9 |
| OC | 4.4 |
| OC | 5.7 |
| OC | 5.9 |
| OC | 6.5 |
| OC | 3.5 |
| OC | 5 |
| OC | 7.5 |
| OC | 6.5 |
| OC | 7.3 |
| OC | 6.6 |
| OC | 5.4 |

TABLE 1-continued

| Mat Type | Wet Strength (oz) |
|---|---|
| OC | 5 |
| OC | 7.7 |
| OC | 3 |
| OC | 9.1 |
| OC | 3.6 |
| OC | 5.7 |
| OC | 6 |
| OC | 6 |
| OC | 7.7 |
| OC | 8.5 |
| Unknown | 8 |

TABLE 2

| Product | Active Weight (grams) | Wet Strength (oz) |
|---|---|---|
| Mg ionomer of EAA | 2.9 | 10.7 |
| Mg ionomer of EAA | 3.7 | 11.3 |
| Mg ionomer of EAA | 2.4 | 13 |
| Zn ionomer of EAA | 2 | 12.1 |
| Zn ionomer of EAA | 2.4 | 12.6 |
| Zn ionomer of EAA | 4.8 | 7.7** |
| Acrylate-acrylamide copolymer | 3.5 | 13.3* |
| Acrylate-acrylamide copolymer | 2.9 | 10.2 |
| Acrylate-acrylamide copolymer | 3.6 | 13.3* |
| Mg ionomer of EAA | 2.5 | 13.2 |
| Mg ionomer of EAA | 0.9 | 9.9*** |
| Mg ionomer of EAA | 0.9 | 13.3* |
| Zn ionomer of EAA | 2.8 | 12.4 |
| Zn ionomer of EAA | 1.8 | 13.3* |
| Zn ionomer of EAA | 1.1 | 13.3* |
| Acrylate-acrylamide copolymer | 2 | 9.6*** |
| Acrylate-acrylamide copolymer | 0.5 | 9.6 |
| Acrylate-acrylamide copolymer | 3.7 | 12.3 |

*Wet strength for these tests was above the upper limits of the test.
**Testing apparatus was bumped during this test, causing the sheet to sag.
***Sheet utilized in these tests were visibly non-uniform.

Example 3

Figure 4:
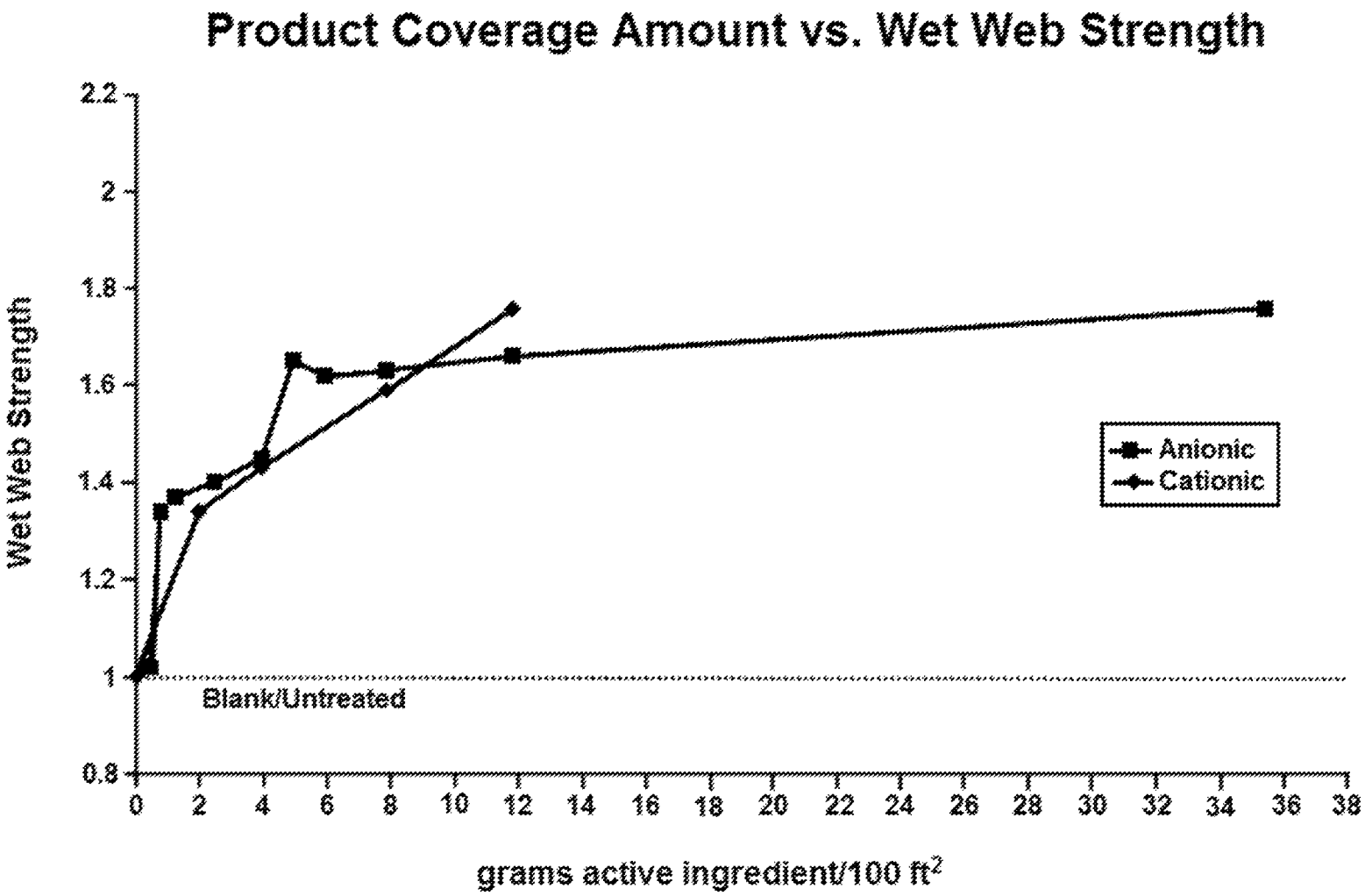
FIG. 4 illustrates wet web strength versus deliver of active ingredient of cationic and anionic strength aid, shown in grams of active ingredient per 100 square feet of web surface area.

For this example, the methods and systems described herein were utilized to spray a cationic strength aid (PAE polymer) onto a web of chopped nonwoven mineral fibers. The application of cationic strength aid in this example followed that of the anionic strength aid in Example 1 described herein. FIG. 4 shows the data of the cationic strength aid as compared to the data of Example 1 related to the anionic strength aid utilized therein. As can be seen in FIG. 4, the cationic data appears to reasonably track the anionic data.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and "at least one" and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. A method of treating a web of chopped nonwoven mineral fibers passing through a chopped nonwoven mineral fiber mat process, the method comprising:

spraying strength aid onto the web of chopped nonwoven mineral fibers in a forming section of the process at a concentration of from about 0.1% to about 20% by weight active ingredient and at a flow rate of from about 0.1 g to about 35 g active ingredient per 100 square feet of surface area of the web of chopped nonwoven mineral fibers, wherein the strength aid is sprayed onto the web upstream of a vacuum section of the process, and binder is applied to the web downstream of the vacuum section.

2. The method of claim 1, wherein the strength aid is cationic, anionic, nonionic, or amphoteric.

3. The method of claim 1, wherein the strength aid is anionic or cationic.

4. The method of claim 1, wherein the strength aid is anionic.

5. The method of claim 1, wherein the strength aid is cationic.

6. The method of claim 1, wherein the strength aid is sprayed onto the web of chopped nonwoven mineral fibers at a concentration of from about 0.3% to about 12% by weight active ingredient.

7. The method of claim 1, wherein the active ingredient of the strength aid comprises an acrylate-containing polymer.

8. The method of claim 1, wherein the active ingredient of the strength aid comprises an acrylate-acrylamide copolymer.

9. The method of claim 1, wherein the active ingredient of the strength aid is an acrylate-acrylamide copolymer.

10. The method of claim 1, wherein the strength aid is sprayed onto the web downstream of a forming head of the chopped nonwoven mineral fiber mat process.

11. The method of claim 1, wherein the strength aid is sprayed onto the web downstream of a forming head and upstream of a vacuum section of the chopped nonwoven mineral fiber mat process.

12. The method of claim 1, wherein the chopped nonwoven mineral fibers comprise glass fibers.

13. The method of claim 1, wherein the web of chopped nonwoven mineral fibers has a thickness of from about 10 to about 45 mil.

14. The method of claim 1, wherein the strength aid further comprises an optical detection compound.

15. The method of claim 14, wherein the optical detection compound comprises fluorescein, rhodamine, naphthalene sodium sulfonate-formaldehyde condensate, di-sulfonated stilbene, tetra-sulfonated stilbene, hexa-sulfonated stilbene, a derivative thereof, or a combination thereof.

* * * * *